US012565291B1

(12) United States Patent
Young

(10) Patent No.: US 12,565,291 B1
(45) Date of Patent: Mar. 3, 2026

(54) EXTENDABLE POLE FOR SHALLOW WATER ANCHORING SYSTEM

(71) Applicant: Billy Young, Mobile, AL (US)

(72) Inventor: Billy Young, Mobile, AL (US)

( * ) Notice: Subject to any disclaimer, the term of this patent is extended or adjusted under 35 U.S.C. 154(b) by 410 days.

(21) Appl. No.: 18/224,115

(22) Filed: Jul. 20, 2023

(51) Int. Cl.
*B63B 21/26* (2006.01)
*B63B 21/46* (2006.01)

(52) U.S. Cl.
CPC ..... *B63B 21/26* (2013.01); *B63B 21/46* (2013.01)

(58) Field of Classification Search
CPC ..... B63B 21/46; B63B 21/26
See application file for complete search history.

(56) References Cited

U.S. PATENT DOCUMENTS 577,220 A * 2/1897 Whitehead ..... B25J 1/04 24/339
D281,393 S * 11/1985 Karnhag ..... D6/552
7,827,927 B2 11/2010 Kivi
7,870,829 B1 * 1/2011 Perry ..... B63B 21/22 114/294
7,921,794 B1 * 4/2011 Cullom ..... B63B 21/502 114/294
8,051,789 B1 * 11/2011 Tylisz ..... B63B 21/22 114/294
8,104,418 B1 * 1/2012 Thompson ..... B63B 21/22 114/364
8,312,832 B1 * 11/2012 Camp ..... B63B 21/26 114/294
D696,096 S * 12/2013 Daneman ..... D8/349
8,661,999 B2 * 3/2014 Blom ..... B63B 21/26 114/294
8,776,712 B2 * 7/2014 Bernloehr ..... B63B 21/24 114/295
9,145,188 B1 * 9/2015 Daneman ..... B63B 21/30
9,656,727 B1 * 5/2017 Stewart ..... B63B 21/26
2009/0223428 A1 * 9/2009 Kivi ..... B63B 21/24 114/230.1
2011/0107952 A1 * 5/2011 Nicholson, IV ..... B63B 21/26 114/230.13
2015/0224350 A1 * 8/2015 Harvey ..... F16M 13/022 248/231.9
2015/0298771 A1 * 10/2015 Kuenzel ..... B63B 21/26 114/295
2017/0233039 A1 * 8/2017 Kuenzel ..... B63B 21/26 114/295
2020/0377177 A1 * 12/2020 Mawson ..... G05D 1/0208
2020/0391826 A1 * 12/2020 Boyd ..... B63B 21/38

* cited by examiner

*Primary Examiner* — Joshua E Freeman
(74) *Attorney, Agent, or Firm* — George L Williamson

(57) ABSTRACT

Method and apparatus for extending the operating depth of an existing shallow water anchoring system which includes a first cylindrical member having a plurality of fasteners thereon which slide over and attach to a distal end of the existing extendable anchoring pole and having a second cylindrical member with fasteners thereon which attach to a new extendable anchoring pole thereby forming a one-piece unit. The first cylindrical member can be slidably moved up and down the existing extendable anchoring pole so as to adjust the operating level of the new extendable anchoring pole so that the distal end of the new extendable anchoring pole can reach the bottom at a greater depth than the operating depth of the existing shallow water anchoring system. The new extendable anchoring pole is also slidable in the second cylindrical member for adjusting its operating depth.

14 Claims, 2 Drawing Sheets

Lowered

Raised

EXTENDABLE POLE FOR SHALLOW WATER ANCHORING SYSTEM

BACKGROUND OF THE INVENTION

Field of the Invention

The present invention relates generally to shallow water anchoring systems and more particularly, is concerned with a system for extending the operating depth of an existing shallow water anchoring system.

Description of the Related Art

Devices relevant to the present invention have been described in the related art; however, none of the related art devices disclose the unique features of the present invention.

In U.S. Pat. No. 9,145,188, dated Sep. 29, 2015, Daneman disclosed a mount providing extension to a shallow water anchoring system. Daneman requires an additional stabilizer block 13 to stabilize the other components due to the shortness in length of the mounting block device 1 unlike the present invention. In U.S. Pat. No. 8,776,712, dated Jul. 15, 2014, Bernloehr, et al., disclosed a shallow water anchor. In U.S. Patent Application Publication No. 2011/0107952, dated May 12, 2011, Nicholson, IV, disclosed an anchor system. In U.S. Pat. No. 7,827,927, dated Nov. 9, 2010, Kivi disclosed an anchoring system for watercraft vessels.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a one-piece, tool-free system for extending the operating depth of an existing shallow water anchoring system which is commonly disposed on the transom of a boat, and having a downwardly disposed existing extendable anchoring pole, the distal tip of which extends into the bottom of the water body upon which the boat is operating. The present invention includes a first cylindrical member having a plurality of fasteners thereon which slide over and attach to a distal end of the existing extendable anchoring pole and having a second cylindrical member with fasteners thereon which attach to a second extendable anchoring pole which is a part of the present invention. The first cylindrical member can be slidably moved up and down the existing extendable anchoring pole so as to adjust the operating level of the new extendable anchoring pole so that the distal end of the new extendable anchoring pole can reach the bottom at a greater depth far exceeding the operating depth of the existing shallow water anchoring system. The second extendable anchoring pole is also slidable in the second cylindrical member for adjusting its operating depth.

An object of the present invention is to increase the depth within a water body to which the new extendable anchoring pole can reach so as to increase the operating depth of the shallow water anchoring system. A further object of the present invention is to provide a system for increasing the operating depth of the shallow water anchoring system which can be easily operated by a user. A further object of the present invention is to provide a system which can be relatively easily and inexpensively manufactured. A further object of the present invention is to provide a system wherein the new extendable anchoring pole does not increase the overall height of the existing underwater anchoring system as it is disposed in a raised position on the transom of a boat.

An advantage of the present invention over the prior art is the distance between the upper and lower ends of the first cylindrical member is effectively long so that the new extendable anchoring pole is held in substantially the upright position without the need for any other stabilizing member being present or used in conjunction with the first or second cylindrical member so that the existing extendable anchoring pole would not be broken off or bent (due to torqueing forces about its centerline) to an excessive angle causing damage thereto. The present invention is also a one-piece, tool-free system.

The foregoing and other objects and advantages will appear from the description to follow. In the description, reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
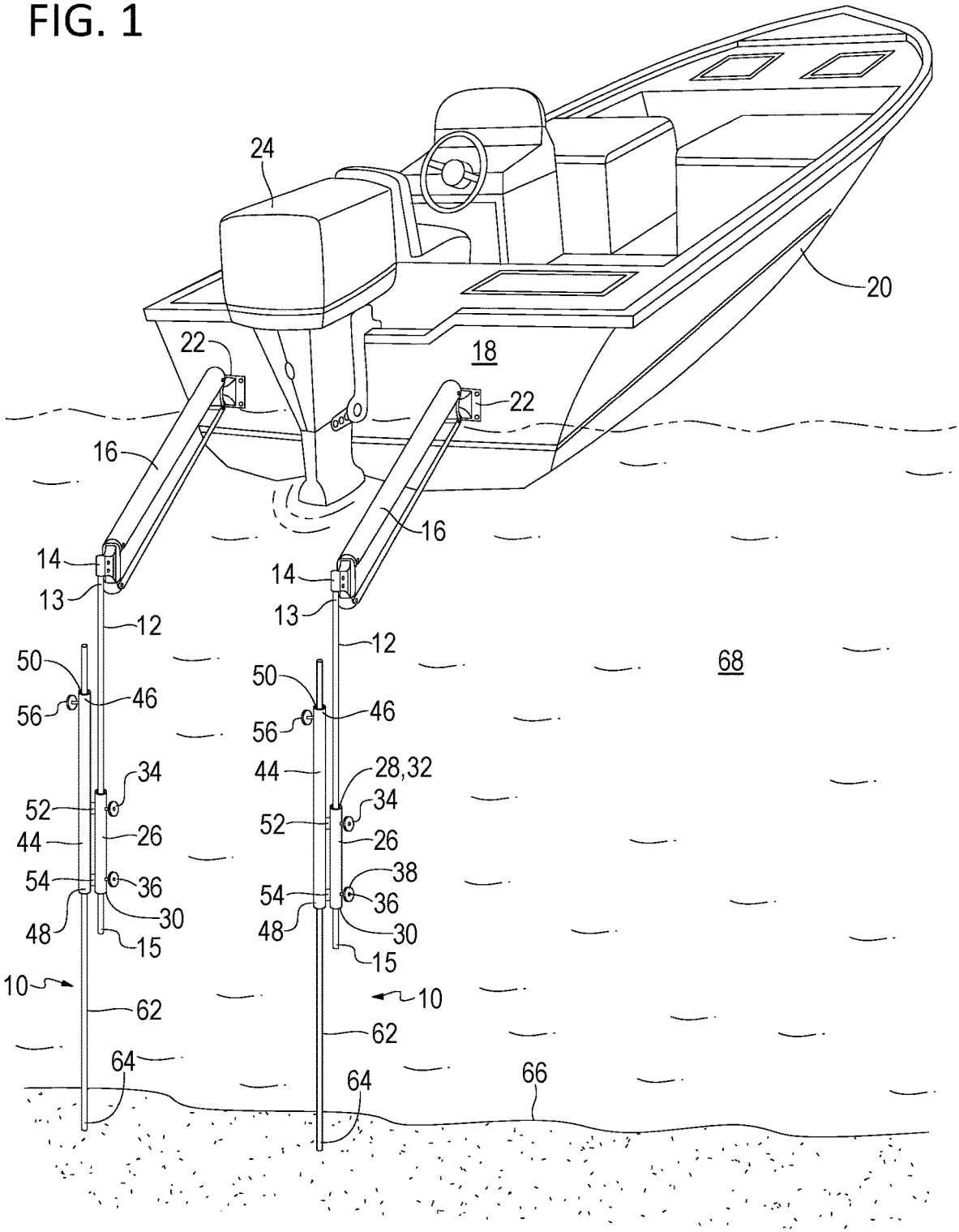
FIG. 1 is a perspective view of the present invention shown in operative connection on an extending shallow water anchoring system.

With regard to reference numerals used, the following numbering is used throughout the drawings.

10 present invention
12 existing extendable anchoring pole
13 upper end
14 connection
15 lower end
16 shallow water anchoring system member
18 transom
20 boat
22 transom mounting member
24 motor
26 first cylindrical member
28 upper end
30 lower end

32 bore
34 upper fastener
36 lower fastener
38 knob
40 threaded shaft
42 aperture
44 second cylindrical member
46 upper end
48 lower end
50 bore
52 fastener
54 additional fastener
56 knob
58 threaded shaft
60 aperture
62 new extendable anchoring pole
64 distal end
66 bottom
68 water body
70 hand
72 tip of shaft

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein an extension for attachment to an existing shallow water anchoring system is disclosed and which is generally indicated by reference number 10.

Figure 4:
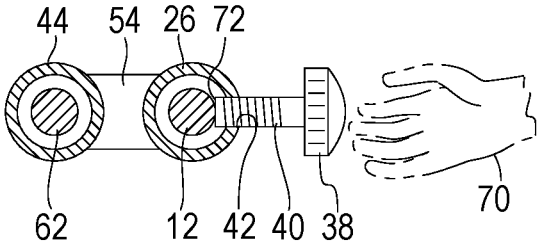
FIG. 4 is a cross-sectional view taken from FIG. 3 as indicated.

Turning to FIG. 1, therein is shown the present invention 10 disposed on an existing extendable anchoring pole 12 having an upper end 13 and a lower end 15 joined to a connector 14 which is disposed on a distal end of a shallow water anchoring system mechanism 16 which is disposed on the transom 18 of a boat 20 using a transom mounting member 22. Also shown on the transom of the boat 20 is a motor 24. The present invention 10 includes a first cylindrical member 26 having upper and lower ends 28, 30 and having a bore 32 extending the full length of the first cylindrical member 26 along with upper and lower fasteners 34, 36. The distance between upper and lower ends 28, 30 is effectively long so that the existing extendable anchoring pole 12 is held in substantially the upright position without the need for any other stabilizing member being present or used in conjunction with the first cylindrical member 26 so that the existing extendable anchoring pole 12 would not be broken off or bent (due to torqueing forces about its centerline) to an excessive angle causing damage thereto. Each fastener includes a knob 38 having a threaded shaft 40 which is inserted into a receiving aperture 42 of the first cylindrical member 26 so that the existing extendable anchoring pole 12 is inserted and extends from the upper end to the lower end of the first cylindrical member 26 and the upper and lower fasteners 34, 36 are used to tightly secure the first cylindrical member 26 to the existing extendable anchoring pole 12 so that the pole 12 does not slide in the first cylindrical member 26. A second cylindrical member 44 having upper and lower ends 46, 48 along with a bore 50 is then attached to the first cylindrical member 26 using a plurality of fasteners 52, for example, welds or the like so that the second cylindrical member 44 is firmly secured to the first cylindrical member 26 thereby forming a one-piece construction. The distance between upper and lower ends 46, 48 is effectively long so that the new extendable anchoring pole 62 is held in substantially the upright position without the need for any other stabilizing member being present or used in conjunction with the second cylindrical member 44 so that the new extendable anchoring pole 62 would not be broken off or bent (due to torqueing forces about its centerline) to an excessive angle causing damage thereto. Possible alternatives for fasteners 52 include brazing, soldering, riveting, metal stitching, and mechanical fasteners such as nuts and bolts, and clamps of various styles. At least one more fastener 54 which could be, for example, a knob 56 having a threaded shaft 58 for insertion into an aperture 60 on the cylindrical portion of the second cylindrical member 44. The knobs 38 can be operated by a hand of a user and therefore provide tool-free operation as illustrated in FIG. 4. A new extendable anchoring pole 62 is then inserted into the bore 50 of the second cylindrical member 44 extending from the upper to the lower end 46, 48 through the bore 50 of the second cylindrical member 44 so that the new pole 62 can have its distal end 64 inserted into the bottom 66 of the water body 68. By using this system of the present invention 10 the operating depth of the original shallow anchoring system 16 can be greatly increased.

Figure 2:
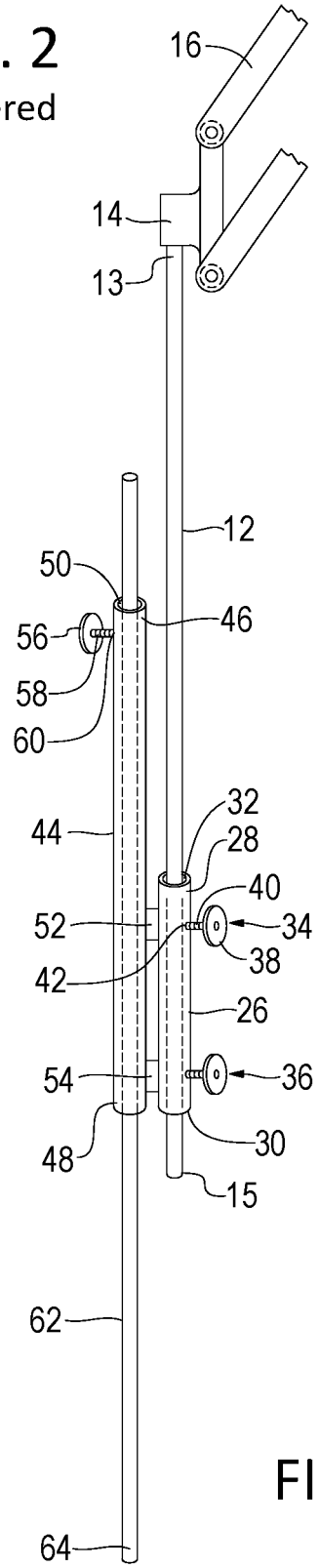
FIG. 2 is a side elevation view of the present invention shown in operative connection on an existing shallow water anchoring system in the lowered position.

Turning to FIG. 2, therein is shown the present invention 10 mounted onto the shallow water anchoring member 16 with the shallow water anchoring member 16 shown in the lowered position.

Figure 3:
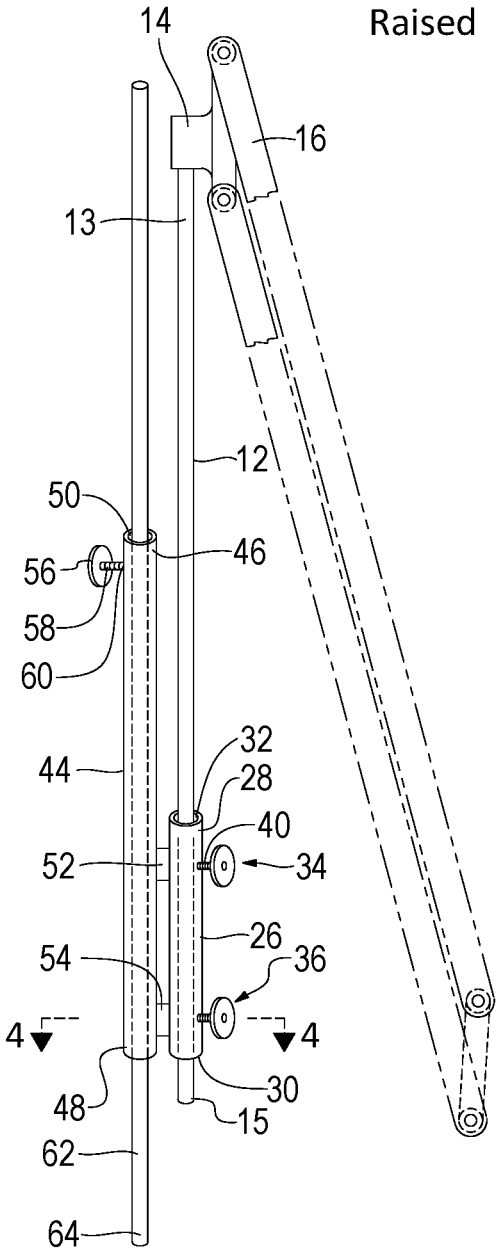
FIG. 3 is a side elevation view of the present invention shown in operative connection on an existing shallow water anchoring system in the raised position.

Turning to FIG. 3, therein is shown the present invention 10 mounted onto the shallow water anchoring member 16 with the shallow water anchoring member 16 shown in the raised position. Note that the elevation of the upper end of the new extendable anchoring pole 62 does not exceed the elevation of the highest point of the shallow water anchoring system member 16. Previously disclosed elements are also shown.

Turning to FIG. 4, therein is shown the first and second cylindrical members 26, 44 joined by fastener 54 along with the internal bores enclosing the existing and new extendable anchoring poles 12, 62. Knob 38 is shown removably securing pole 12 by having the tip 72 of the threaded shaft 40 make direct contact with the surface of the pole 12. Turning knob 38 in a first direction tightens it against the pole 26 and turning the knob in the opposite direction loosens the pole 26. Also illustrated is the fact that no tools, i.e., tool-free, are needed to operate the present invention 10 as only a hand 70 of a user is required to operate the knob 38 which is necessary to adjust the height of the two poles 12, 62 and so that the present invention 10 can be attached to and removed from the existing extendable anchoring pole. Also illustrated is the one-piece design of the present invention 10 in that the construction of the present invention creates a one-piece design by having the first and second cylindrical members 26, 44 be joined together permanently by fasteners 52, 54.

Exemplary dimensions include the first cylindrical member being approximately 12" long, the second cylindrical member being approximately 18" long, and the new extendable anchoring pole being approximately 4' long.

By way of summary and by making reference to FIGS. 1-4, the present invention 10 discloses a system for extending the operating depth of an existing shallow water anchoring system 12, 16, including a first cylindrical member 26 having upper and lower ends and a first bore therein, an existing extendable anchoring pole 12 disposed in the first bore and extending completely through the first bore from the upper end to the lower end, wherein the existing extendable anchoring pole is slidable internal the first cylindrical member; a first fastener 34 for removably attaching the first cylindrical member to the existing extendable anchoring pole so that the existing extendable anchoring pole is slidably adjustable along the first cylindrical member; a second cylindrical member 44 having upper and lower ends and a second bore therein, a new extendable anchoring pole 62 disposed in the second bore and extending completely through the second bore from the upper end to the lower end, wherein the new extendable anchoring pole is slidable internal the second cylindrical member; a second fastener 56 for removably attaching the second cylindrical member to the new extendable anchoring pole so that the new extendable anchoring pole is slidably adjustable along the second cylindrical member; wherein the second cylindrical member is fixedly attached at 52, 54 to the first cylindrical member; and wherein a distal end 64 of the new extendable anchoring pole reaches to a greater depth in the water body 68 than a distal end of the existing extendable anchoring pole.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e, methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description may be intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively inclusive elements includes at least one element of the listed elements. However, an example described using a list of alternatively inclusive elements does not preclude another example that includes all of the listed elements. An example described using a list of alternatively inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

I claim:

1. A system for extending an existing shallow water anchoring system, comprising:

(a) said shallow water anchoring system having an existing extendable anchoring pole for anchoring a boat to a bottom of a waterbody;

(b) a first cylindrical member having upper and lower ends and a first bore therein, said existing extendable anchoring pole disposed in said first bore and extending completely through said first bore from said upper end to said lower end, wherein said existing extendable anchoring pole is slidable internal said first cylindrical member;

(c) a first fastener for removably attaching said first cylindrical member to said existing extendable anchoring pole so that said existing extendable anchoring pole is slidably adjustable along said first cylindrical member;

(d) a second cylindrical member having upper and lower ends and a second bore therein, a new extendable anchoring pole disposed in said second bore and extending completely through said second bore from said upper end to said lower end, wherein said new extendable anchoring pole is slidable internal said second cylindrical member;

(e) a second fastener for removably attaching said second cylindrical member to said new extendable anchoring pole so that said new extendable anchoring pole is slidably adjustable along said second cylindrical member;

(f) wherein said second cylindrical member is fixedly attached to said first cylindrical member;

(g) wherein a distal end of said new extendable anchoring pole reaches to a greater depth in said water body than a distal end of said existing extendable anchoring pole; and (h) wherein said first cylindrical member is approximately twelve inches in length and said second cylindrical member is approximately eighteen inches in length.

2. The extendable pole of claim 1, wherein a distance between said upper and lower end of said first cylindrical member is effectively long so that said new extendable anchoring pole is held in substantially an upright position without need of any other stabilizing member being present on said first cylindrical member.

3. The extendable pole of claim 1, wherein a distance between said upper and lower end of said first cylindrical member is effectively long so that said existing extendable anchoring pole would not be bent to an excessive angle so as to cause damage thereto without need of any other stabilizing member being present on said first cylindrical member.

4. The extendable pole of claim 1, wherein said first and second cylindrical members are fixedly attached to each other so as to form a one-piece construction.

5. The extendable pole of claim 4, wherein said first and second cylindrical members are joined by welding.

6. The extendable pole of claim 1, wherein said first fastener is actuated by a first knob, said first knob for being grasped by a hand of a user wherein said first knob is operated tool-free.

7. The extendable pole of claim 1, wherein said second fastener is actuated by a second knob, said second knob for being grasped by a hand of a user wherein said second knob is operated tool-free.

8. A method for extending an existing shallow water anchoring system, comprising the steps of:

(a) providing the shallow water anchoring system having an existing extendable anchoring pole for anchoring a boat to a bottom of a waterbody;

(b) providing a first cylindrical member having upper and lower ends and a first bore therein, the existing extendable anchoring pole disposed in the first bore and extending completely through the first bore from the upper end to the lower end, wherein the existing extendable anchoring pole is slidable internal the first cylindrical member;

(c) providing a first fastener for removably attaching the first cylindrical member to the existing extendable anchoring pole so that the existing extendable anchoring pole is slidably adjustable along the first cylindrical member;

(d) providing a second cylindrical member having upper and lower ends and a second bore therein, a new extendable anchoring pole disposed in the second bore and extending completely through the second bore from the upper end to the lower end, wherein the new extendable anchoring pole is slidable internal the second cylindrical member;

(e) providing a second fastener for removably attaching the second cylindrical member to the new extendable anchoring pole so that the new extendable anchoring pole is slidably adjustable along the second cylindrical member;

(f) fixedly attaching the second cylindrical member to the first cylindrical member;

(g) wherein a distal end of the new extendable anchoring pole reaches to a greater depth in the water body than a distal end of the existing extendable anchoring pole; and (h) wherein the first cylindrical member is approximately twelve inches in length and the second cylindrical member is approximately eighteen inches in length.

9. The method of claim 8, wherein a distance between the upper and lower end of the first cylindrical member is effectively long so that the new extendable anchoring pole is held in substantially an upright position without need of any other stabilizing member being present on the first cylindrical member.

10. The method of claim 8, wherein a distance between the upper and lower end of the first cylindrical member is effectively long so that the existing extendable anchoring pole would not be bent to an excessive angle so as to cause damage thereto without need of any other stabilizing member being present on the first cylindrical member.

11. The method of claim 8, wherein the first and second cylindrical members are fixedly attached to each other so as to form a one-piece construction.

12. The method of claim 11, wherein the fit and second cylindrical members are joined by welding.

13. The method of claim 8, wherein the first fastener is actuated by a first knob, the first knob for being grasped by a hand of a user wherein the first knob is operated tool-free.

14. The method of claim 8, wherein the second fastener is actuated by a second knob, the second knob for being grasped by a hand of a user wherein the second knob is operated tool-free.

* * * * *